US005604044A

United States Patent [19]

McCabe et al.

[11] Patent Number: 5,604,044

[45] Date of Patent: Feb. 18, 1997

[54] BLANKS FOR SHEET MATERIAL FORMING PROCESS

[76] Inventors: Charles J. McCabe, 10725 Indigo Ct., Fishers, Ind. 46038; Ronald W. Stevens, R.R. No. 5, Box 123, Frankfort, Ind. 46041

[21] Appl. No.: 384,443

[22] Filed: Feb. 2, 1995

Related U.S. Application Data

[63] Continuation of Ser. No. 998,267, Dec. 28, 1992, abandoned.

[51] Int. Cl.[6] ..... B21C 1/00

[52] U.S. Cl. ..... 428/577; 428/542.8; 220/62

[58] Field of Search ..... 428/577, 578, 428/579, 580, 581, 542.8; 83/40, 41, 55; 220/62, 62.1; 72/338, 339

[56] References Cited

U.S. PATENT DOCUMENTS

| | | | |
|---|---|---|---|
| 228,939 | 6/1880 | Rogers | 83/56 |
| 1,441,359 | 1/1923 | Langston | 83/41 |
| 2,188,310 | 1/1940 | Price | 428/578 |
| 2,335,292 | 11/1943 | Messenger | 164/17 |
| 2,363,358 | 11/1944 | Punte | 164/17 |
| 2,765,760 | 10/1956 | Lyon | 72/338 |
| 3,015,879 | 1/1962 | Babitt | 428/579 |
| 3,034,466 | 5/1962 | Brandes et al. | 428/579 |
| 3,239,916 | 3/1966 | Love | 29/155.5 |
| 3,248,184 | 4/1966 | Osborn et al. | 428/578 |
| 3,596,493 | 8/1971 | Lachavssee | 72/339 |
| 3,668,959 | 6/1972 | Richter et al. | 83/48 |
| 3,762,205 | 10/1973 | Franz et al. | 72/339 |
| 3,776,017 | 12/1973 | Ikeda et al. | 7/338 |
| 3,969,811 | 7/1976 | Zahn | 29/417 |
| 4,005,665 | 2/1977 | Nishihara et al. | 83/40 |
| 4,681,001 | 7/1987 | Uehlinger et al. | 83/41 |
| 4,856,392 | 8/1989 | Appelberg | 83/40 |
| 5,044,237 | 9/1991 | Frame | 83/55 |

*Primary Examiner*—John Zimmerman
*Attorney, Agent, or Firm*—Lundy and Associates

[57] ABSTRACT

A blank for a sheet metal forming process having a part portion surrounded by a peripheral portion. The peripheral portion has a portion thereof which is discontinuous whereby scrap is minimized.

51 Claims, 6 Drawing Sheets

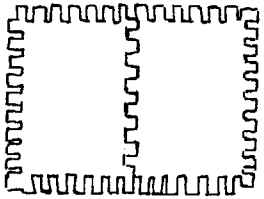
SYMMETRICAL NORMAL
FIG. 9
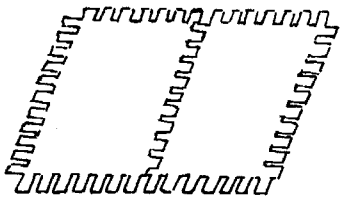
SYMMETRICAL ANGULAR
FIG. 10
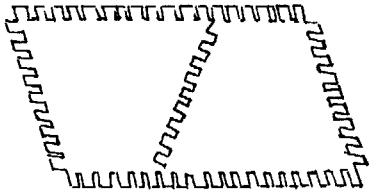
SYMMETRICAL ANGULAR INVERSE
FIG. 11
SYMMETRICAL CURVALINEAR
FIG. 12
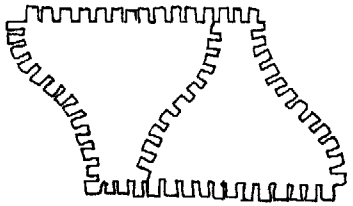
SYMMETRICAL CURVALINEAR INVERSE
FIG. 13
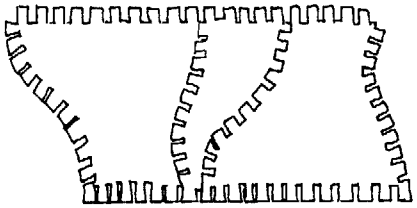
ASYMMETRIC CURVALINEAR INVERSE
FIG. 14
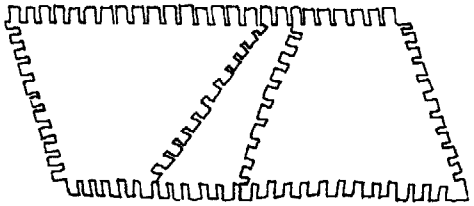
ASYMMETRICAL RECTILINEAR INVERSE
FIG. 15

BLANKS FOR SHEET MATERIAL FORMING PROCESS

This is a continuation of application Ser. No. 07/998,267, filed on Dec. 28, 1992, now abandoned.

BACKGROUND OF THE INVENTION

The present invention pertains to a method of producing blanks from a coiled ribbon of sheet material and blanks produced thereby, and more particularly, to blanks for sheet material forming processes and a method of producing the same from coiled ribbons of sheet material in which scrap is minimized.

Sheet metal forming processes have long been used and range from drawing, bending, straightening, stretching, shearing, punching, piercing, extruding, notching, parting, nibbling, perforating, dimpling, corrugating, curling, wiring, hemming, seaming, bulging, necking, swaging, spinning, coining, embossing, ironing, flanging, stretch forming, juggling, slitting, shaving, lancing, trimming, slotting, and combinations thereof. Many complex parts from sheet metal are formed of different sizes including auto body parts such as fenders, trunk lids, and hoods, appliance bodies such as refrigerator shells, range and dishwasher bodies and the like. The largest practical blanks from sheet or coiled steel are used in the automotive industry for floors and roofs of automobiles. The smallest blanks are generally used in the precious metal industry for electrical contact tips, these blanks being almost microscopic in size. Similar processes are now being used with other deformable materials such as plastics and composites.

In performing each of these operations and forming blanks for each of these parts, the minimization of scrap is always desirable. However, it is well known to those familiar with such operations that the tooling requires the application of a technology which is only limited by the composition of the material and its physical properties. In each of the operations there are limitations beyond which the material cannot be formed without splitting, cracking or otherwise stretching the material beyond its limits by which failure of the part is assured.

Essential in all forming processes is the production of a blank having a part portion surrounded by a scrap portion. The scrap portion must be significantly large in order for the blank to be grasped firmly in the tooling between the upper binder and the lower binder during the forming process. This scrap portion must be large enough to insure a firm grip and yet allow the part to be formed without failure of the part beginning in the scrap portion of the blank. While lock beads, gripper beads, other material flow restrictions, or other discontinuities in the scrap portion may tend to insure the necessary grip and to minimize scrap, there is always a necessity for good blank design and blank layout on a ribbon of coiled sheet material from which the blanks are formed.

While it is known in other art in the textile industry and the like to design blanks in a manner to efficiently utilize sheet material (see, for example, U.S. Pat. No. 2,335,292 issued to Messenger on Nov. 30, 1943) these techniques have not been utilized in the sheet metal forming industry, as many such techniques do not allow for the necessary scrap portion of the blank required by the forming process, and that it has been experienced and thought in the past that any discontinuous boundary could be the site for splits resulting from metal stretching during the forming process. While these blank designs do conserve material, blank designs previously used on textiles and paper, cardboard, plasterboard, etc. , have not been deemed applicable to the sheet material forming industry and its processes. In fact, the sheet material forming industry has discarded the notion and taught away from use of such blanks having a discontinuous boundary portion for all of the above reasons.

In this context, it is therefore highly desirable to provide a new and novel blank for a sheet material forming process and a plurality of blanks for a sheet material forming process arranged on a roll of sheet material and a method of producing a plurality of blanks from a coiled ribbon of sheet material.

It is also highly desirable to provide a new and novel blank for a sheet material forming process and a plurality of blanks for a sheet material forming process arranged on a roll of sheet material and a method of producing a plurality of blanks from a coiled ribbon of sheet material which minimizes scrap and maximizes the number of blanks formed from the sheet material.

It is also highly desirable to provide a new and novel blank for a sheet material forming process and a plurality of blanks for a sheet material forming process arranged on a roll of sheet material and a method of producing a plurality of blanks from a coiled ribbon of sheet material which has at least one boundary portion which is discontinuous.

It is also highly desirable to provide a new and novel blank for a sheet material forming process and a plurality of blanks for a sheet material forming process arranged on a roll of sheet material and a method of producing a plurality of blanks from a coiled ribbon of sheet material in which at least one portion of the peripheral scrap portion of the blank is shared with adjacent blanks.

It is also highly desirable to provide a new and novel Blank for a sheet material forming process and a plurality of blanks for a sheet material forming process arranged on a roll of sheet material and a method of producing a plurality of blanks from a coiled ribbon of sheet material in which at least two boundaries are discontinuous.

It is also highly desirable to provide a new and novel blank for a sheet material forming process and a plurality of blanks for a sheet material forming process arranged on a roll of sheet material and a method of producing a plurality of blanks from a coiled ribbon of sheet material in which at least two peripheral scrap portions of the blank are shared with adjacent blanks.

It is also highly desirable to provide a new and novel blank for a sheet material forming process and a plurality of blanks for a sheet material forming process arranged on a roll of sheet material and a method of producing a plurality of blanks from a coiled ribbon of sheet material which includes all of the above desired features.

SUMMARY OF THE INVENTION

It is therefore an object of the invention to provide a new and novel blank for a sheet material forming process and a plurality of blanks for a sheet material forming process arranged on a roll of sheet material and a method of producing a plurality of blanks from a coiled ribbon of sheet material.

It is also an object of the invention to provide a new and novel blank for a sheet material forming process and a plurality of blanks for a sheet material forming process arranged on a roll of sheet material and a method of producing a plurality of blanks from a coiled ribbon of sheet material which minimizes scrap and maximizes the number of blanks formed from the sheet material.

It is also an object of the invention to provide a new and novel blank for a sheet material forming process and a plurality of blanks for a sheet material forming process arranged on a roll of sheet material and a method of producing a plurality of blanks from a coiled ribbon of sheet material which has at least one boundary portion which is discontinuous.

It is also an object of the invention to provide a new and novel blank for a sheet material forming process and a plurality of blanks for a sheet material forming process arranged on a roll of sheet material and a method of producing a plurality of blanks from a coiled ribbon of sheet material in which at least one portion of the peripheral scrap portion of the blank is shared with adjacent blanks.

It is also an object of the invention to provide a new and novel blank for a sheet material forming process and a plurality of blanks for a sheet material forming process arranged on a roll of sheet material and a method of producing a plurality of blanks from a coiled ribbon of sheet material in which at least two boundaries are discontinuous.

It is also an object of the invention to provide a new and novel blank for a sheet material forming process and a plurality of blanks for a sheet material forming process arranged on a roll of sheet material and a method of producing a plurality of blanks from a coiled ribbon of sheet material in which at least two peripheral scrap portions of the blank are shared with adjacent blanks.

It is also an object of the invention to provide a new and novel blank for a sheet material forming process and a plurality of blanks for a sheet material forming process arranged on a roll of sheet material and a method of producing a plurality of blanks from a coiled ribbon of sheet material which includes all of the above desired features.

In the broader aspects of the invention there is provided a blank for a sheet material forming process having a part portion surrounded by a peripheral portion. The peripheral portion has a portion thereof which is discontinuous whereby scrap is minimized.

BRIEF DESCRIPTION OF THE DRAWINGS

FIGS. 9–15 are top plan views of blanks of the invention all having a part of the peripheral scrap portion being shared by adjacent blanks, each having different shapes.

DESCRIPTION OF A SPECIFIC EMBODIMENT

Figure 1:
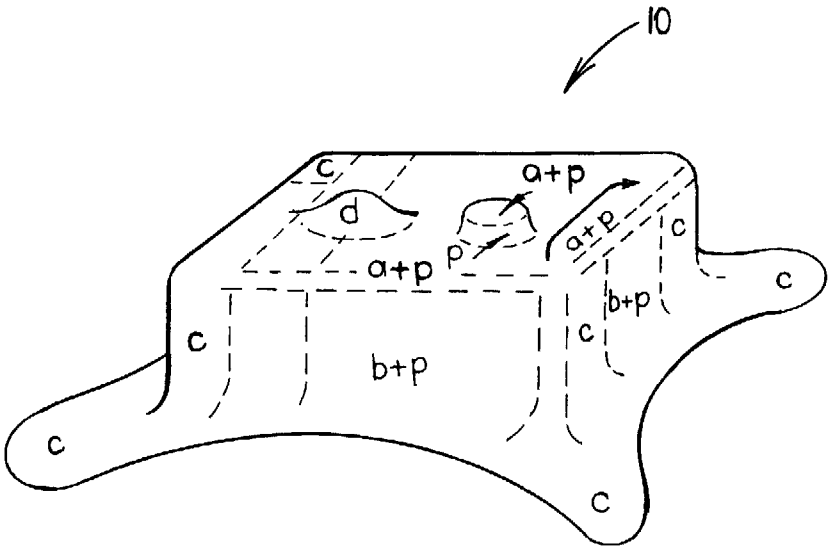
FIG. 1 shows a complex stamping from a blank utilizing bending, straightening, cup drawing, biaxial stretching, and strained stretching metal forming processes.

FIG. 1 illustrates a complex stamping 10 after a blank of the invention has undergone various sheet material forming processes. These processes include bending "a", bending and straightening "b", cup drawing "c", dome or biaxial stretching "d", and plane strain stretching "e".

Figure 3:
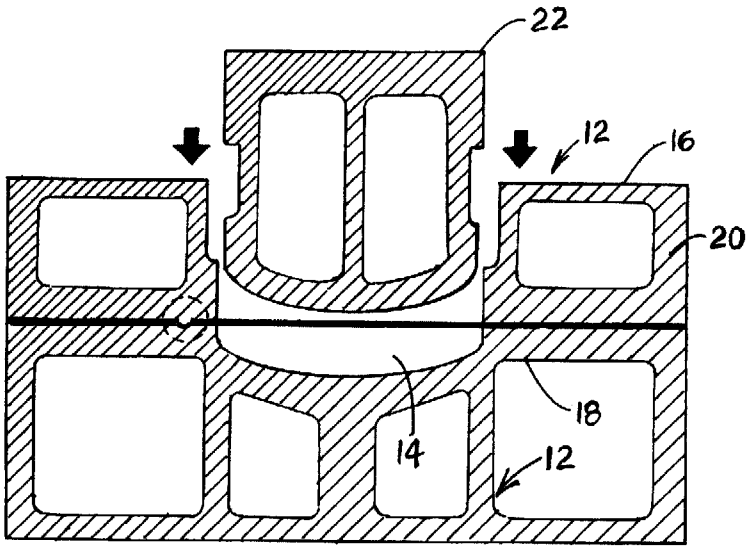
FIG. 3 illustrates in cross-section, a die having a die cavity, a lower binder, an upper binder, a blank with a bead, and a punch taken substantially along the section line 3—3 of FIG. 2.
Figure 2:
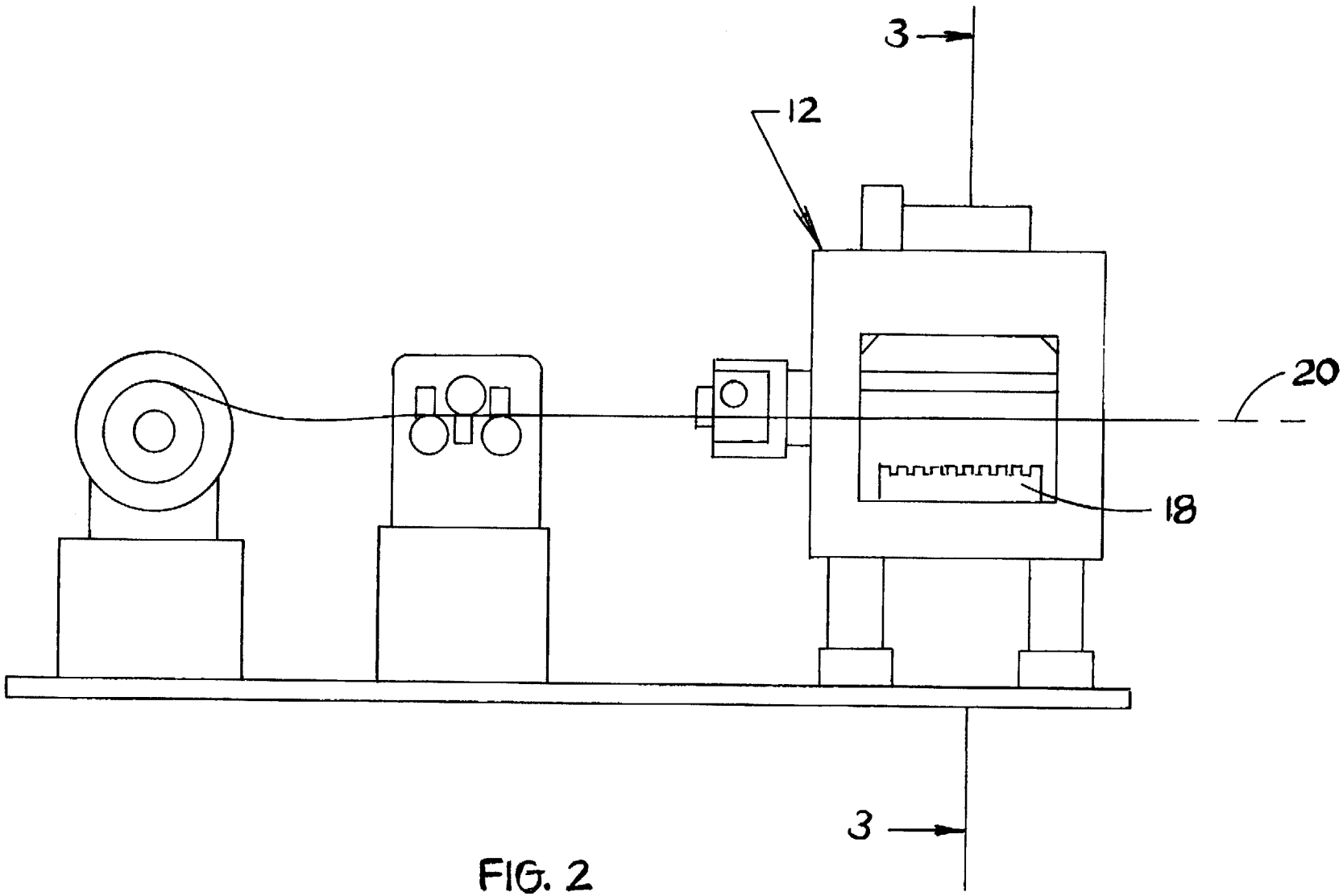
FIG. 2 is a diagrammatic illustration of a typical metal forming production line.
Figure 4:
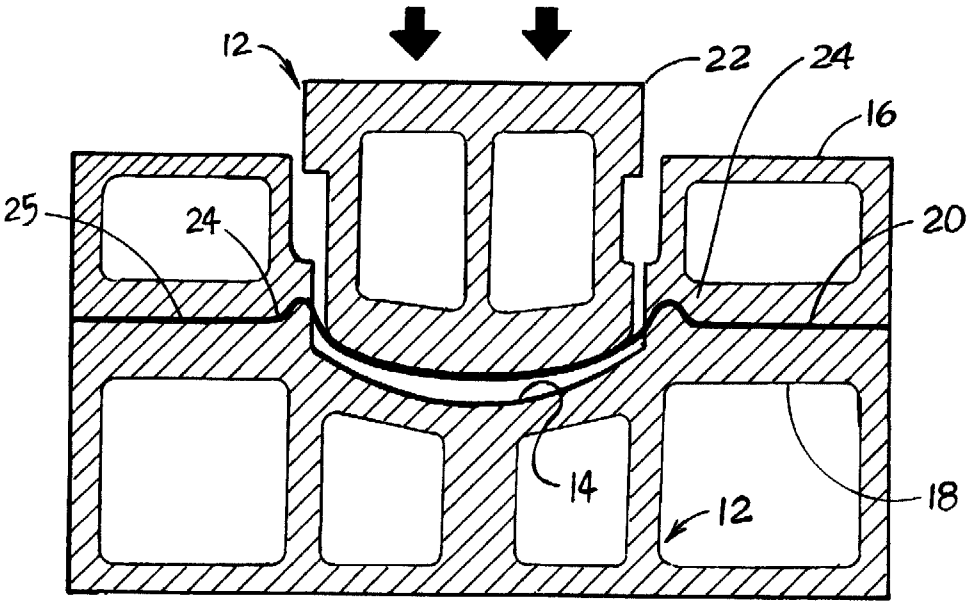
FIG. 4 is a die illustrated similar to FIG. 3 showing lock beads on opposite sides of the die cavity.

Each of these procedures is accomplished in one or more varieties of press dies in a production line such as illustrated in FIG. 2. One such die 12 is shown in FIGS. 3 and 4 to include a die cavity 14, upper 16 and lower 18 binders, a blank 20 held between the upper 16 and lower 18 binders, and a punch 22. It is essential in such forming that the blank 20 be held firmly between the upper 16 and lower 18 binders. In some dies 12 utilizing some tooling, beads or other flow restrictions 24 are utilized at times to provide more resistance to blank movement between the binders 16, 18 and more resistance to material flow, thus, insuring more control of material movement into the die cavity 14.

Figure 6:
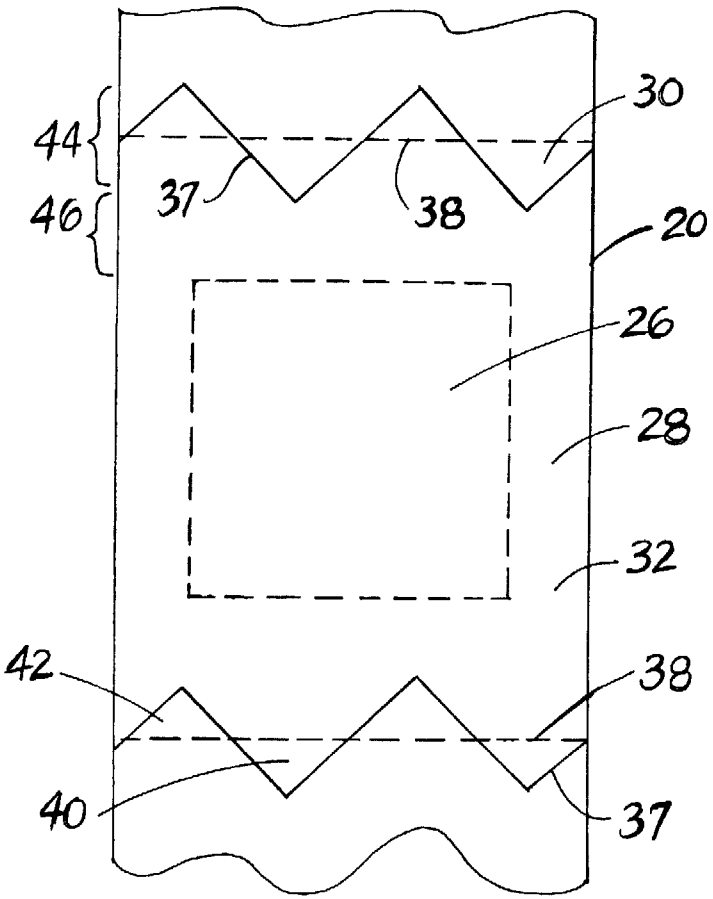
FIG. 6 is a fragmentary top plan view of a coiled ribbon of sheet material with rectangular/square blanks of the invention arranged thereon having opposite, shared, discontinuous peripheral scrap portions.
Figure 5:
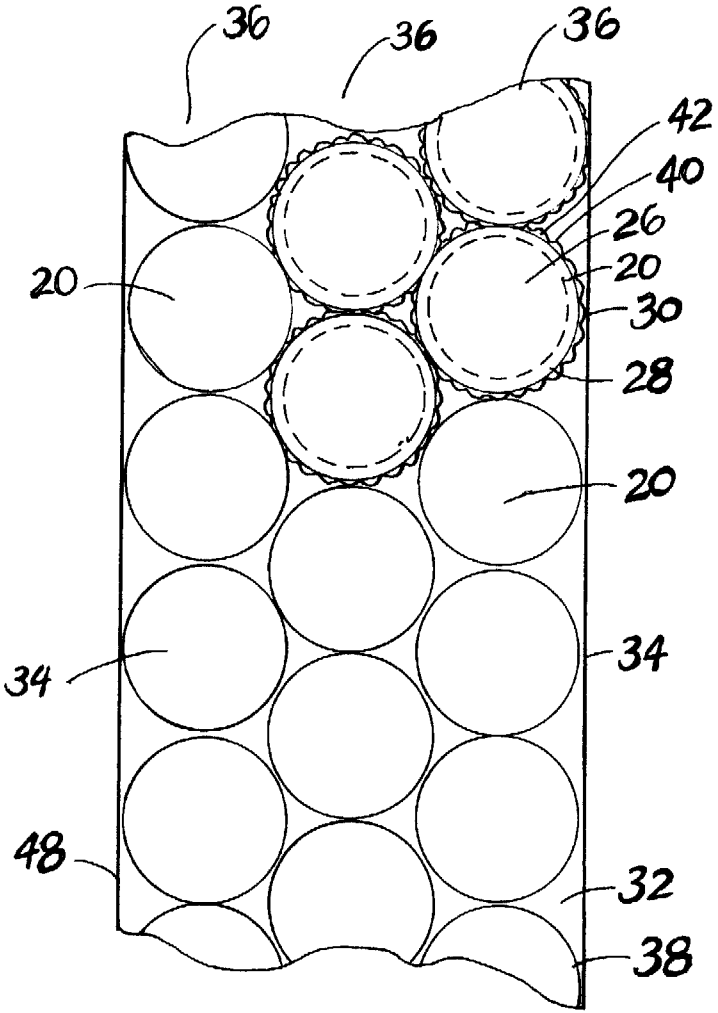
FIG. 5 is a fragmentary top plan view of a coiled ribbon of sheet material with circular blanks of the invention arranged thereon having opposite, shared, discontinuous peripheral scrap portions.

Referring to FIGS. 5 and 6, it can be readily seen that each blank 20 comprises a part portion 26 surrounded by a peripheral portion 28. The peripheral portion 28 of the invention has a predominant peripheral portion 30 which is discontinuous. In specific embodiments, all or a portion of peripheral portion 28 is scrap. In most cases, the peripheral portion 28 is scrap. In other cases, all or a portion of portion 28 may be used to flange an edge of the part produced. In still other cases, part portion 26 is only partially bounded by a peripheral portion 28. In specific embodiments, blanks 20 of the invention may have peripheral portions of one or more of these possibilities. The figures disclose only the most common possibility.

In the specific embodiments shown in FIG. 6, the bead 24 is in the peripheral portion 28 between the part portion 26 and the peripheral discontinuous portion 30. In all embodiments, the blanks 20 have an undulating real boundary 37 and a discontinuous effective boundary 38. See FIG. 6. In the blank 20 shown in FIG. 7, the lock or draw or gripper or other flow restriction bead 24 is in the peripheral discontinuous portion 30.

In all embodiments of the blank 20 of the invention, portion 28 is adapted to be positioned between the upper binder 16 and the lower binder 18 of a die 12 or other sheet material forming tooling. In the embodiment shown in FIG. 7, only the peripheral discontinuous portion 30 is adapted to be positioned between the upper 16 and lower 18 binder of the sheet material forming tooling used.

FIG. 5 illustrates a plurality of circular blanks 20 for a sheet material forming process arranged on a coiled ribbon 32 of sheet material. Three rows 34 of Blanks 20 are shown. The blanks 20 are arranged in staggered columns 36 extending transversely of the longitudinal direction of the ribbon 32 of sheet material. Each of the blanks 20 have an outer scrap portion 28 having a peripheral portion 30 which is discontinuous. Each of the blanks 20 are circular. The entire outer boundary 38 of the blanks 20 is discontinuous in accordance with the invention. As shown, the discontinuity of the outer peripheral boundary 38 of each blank 20 is in the form of alternating tabs 40 and notches 42. Each of the notches 42 are spaced apart with a tab 40 therebetween. Each of the tabs 40 and notches 42 are radiused. Each of the tabs 40 and notches 42 are equally spaced and of equal size. In the specific embodiment shown, the outer peripheral boundary 38 of each blank 20 is in the generalized form of a sinusoidal scrolled or scalloped boundary 38.

Referring to FIG. 6, there is shown a blank 20 for a sheet material forming process of the invention laid out on a ribbon 32 of sheet material. The blank 20 of the invention bas a part portion 26 surrounded by a portion 28, portion 28 bas a predominant discontinuous peripheral portion 30. The predominant discontinuous peripheral portion 30 is shared between adjacent blanks 20. The shared portion 30 is less than all of the portion 28 as the portion 28 includes both a shared portion 44 and an unshared portion 46. The unshared portion 46 is between the shared portion 42 and the part portion 26 of the blank 20. The blank 20 is rectangular. In the specific embodiment illustrated, the rectangular blank 20 is shown to be square. A material forming or lock bead 24 may be formed in the unshared scrap portion 46. See FIGS. 3 and 4. In the embodiment shown in FIG. 6, each blank 20 has a pair of opposite portions 28 which are shared with adjacent blanks 20. The blank 20 also has a pair of opposite portions 28 which are not shared with adjacent blanks 20. These unshared portions 46 define the longitudinal edges 48 of the ribbon 32 of sheet material from which the blanks 20 are produced. The portions 28 have essentially the same width dimension whether they are shared or unshared.

Figure 7:
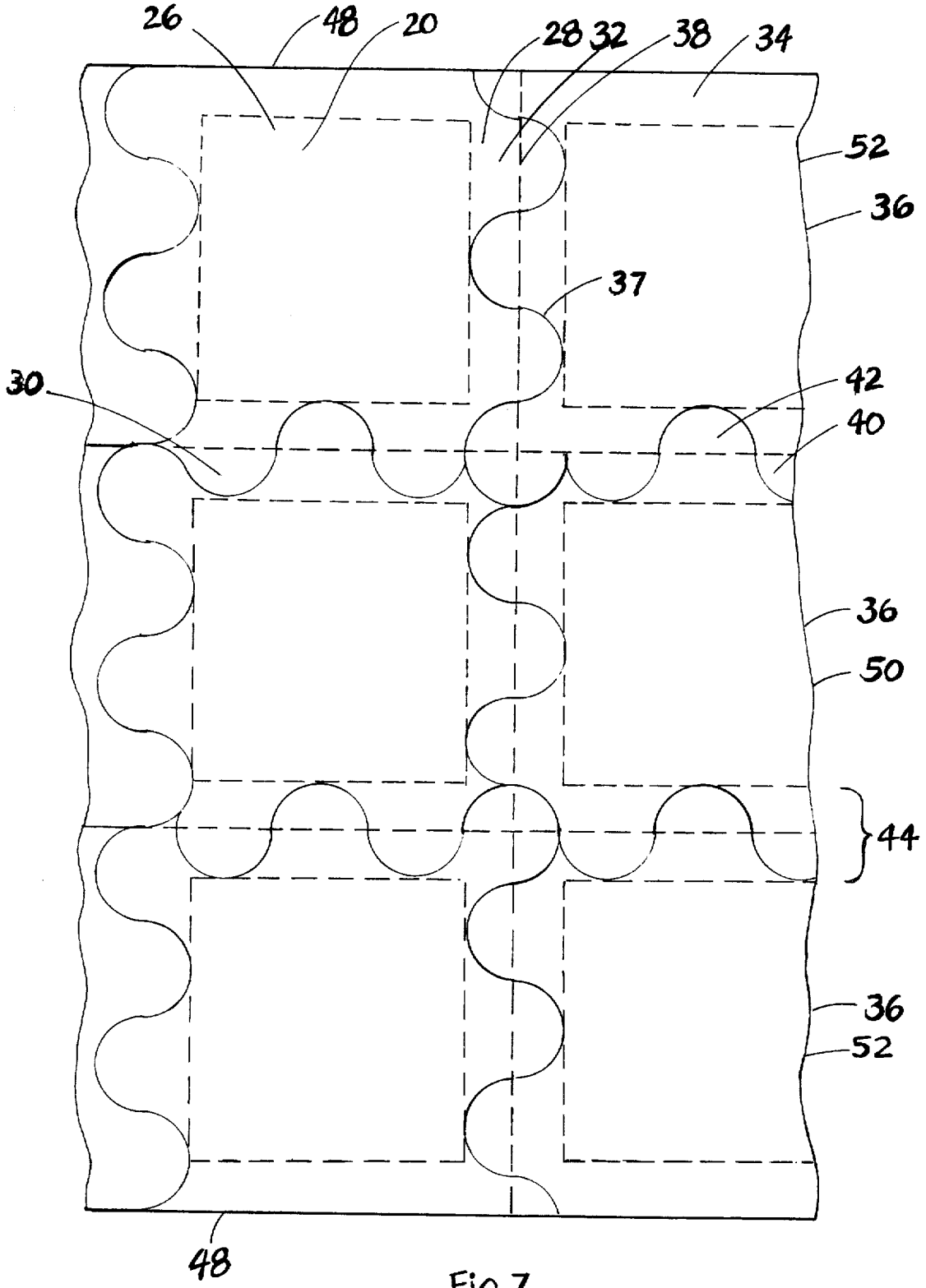
FIG. 7 is a fragmentary top plan view of a coiled ribbon of sheet material showing three rows of rectangular/square blanks arranged thereon with the blanks of the intermediate row having two pair of oppositely disposed shared scrap portions with adjacent blanks and the entire peripheral scrap portion being shared by adjacent blanks, and the outside rows having three adjacent discontinuous scrap portions being shared by adjacent blanks with the remaining scrap portion defining the longitudinal edge of the ribbon.

Referring to FIG. 7, a plurality of blanks 20 of the invention is shown on a portion of a coiled ribbon 32 of sheet material from which the blanks 20 are produced. The blanks 20 are arranged in a plurality of rows 34 and columns 36 extending transversely and longitudinally of the sheet material ribbon 32. The blanks 20 on the inner columns 36 each have a part portion 26 and a peripheral portion 28. Each of the interior blanks 50 have opposite shared portions 44. The opposite shared portions 44 are shown to be the entire peripheral portion of the blank 20 and to have a peripheral portion 30 which is discontinuous in the form of alternate radiused tabs 40 and notches 42. In a specific embodiment, these discontinuous peripheral portions 30 could be only a portion of the portion 28 as shown in FIG. 6.

Each of the outer columns 36 of blanks 52 has a peripheral portion 30 connecting the two opposite shared peripheral portions 30 which are also discontinuous. The remaining peripheral portion 30 is continuous and defines the longitudinal edge 48 of the ribbon of sheet metal from which the blanks are formed.

In a specific embodiment, there may be a plurality of inner columns 36 of blanks 50 each of which will be identical. The blanks 50 of the interior columns 36 each have a part portion 26 and a scrap portion 28. Each of the scrap portions 28 has a predominant peripheral portion 30 which is discontinuous. Each of the blanks 20 have two pair 54 of opposite peripheral portions 30, all four of which are discontinuous.

In a specific embodiment, a plurality of blanks 20 can be positioned on a coiled ribbon 32 in two columns and a plurality of rows 34. In this embodiment, where the columns 36 are divided by a shared portion 44 and the rows are not, rectangular or square blanks 20 have only a single shared peripheral boundary. Also in this embodiment, where both the columns and the rows are divided by a shared portion 44, rectangular and square blanks 20 have three adjacent peripheral portions shared by adjacent blanks 20.

Figure 8:
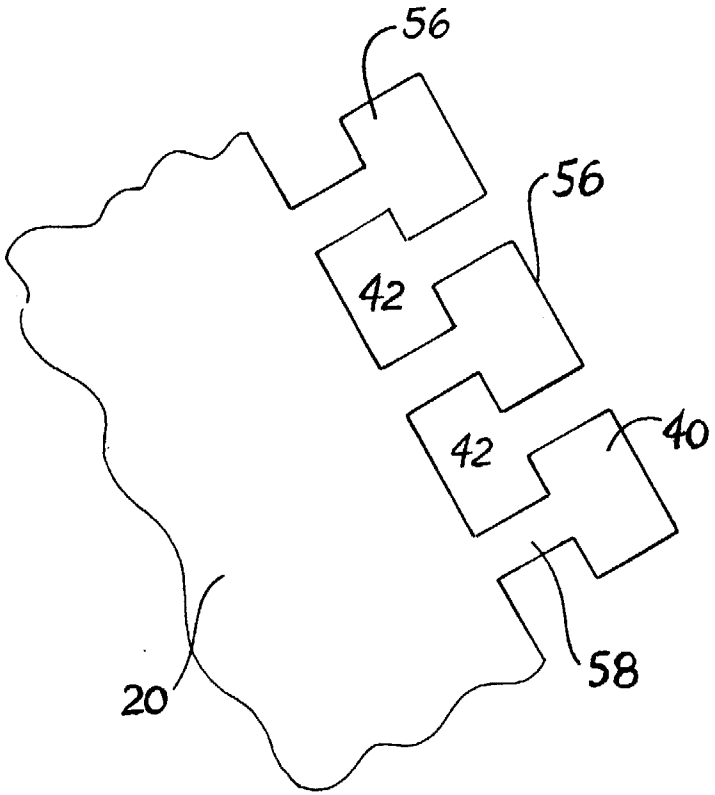
FIG. 8 is a fragmentary view similar to FIG. 6 showing an alternate discontinuous portion.

In a specific embodiment of the blanks shown in FIGS. 5–7, the discontinuous peripheral portions 30 are each a plurality of tabs 40 and notches 42. These tabs 40 and notches 42 may have several different shapes, have a variety of sizes, and be supplied in a variety of numbers. Each of the tabs 40 and notches 42, in a specific embodiment, are radiused. In other specific embodiments, the tabs 40 and notches 42 are each square/rectangular with radiused corners. See FIGS. 9–15. In other specific embodiments, each of the tabs 40 and notches 42 are triangular as in a saw-toothed edge with radiused corners. See FIG. 6. In another specific embodiment, each of the tabs 40 have an enlarged head portion 56 and a neck portion 58. See FIG. 8. Neck portion 58 is between the remainder of blank 20 and head portion 56. Head portion 56 is spaced from the remainder of blank 20 by neck portion 58. In other specific embodiments, each of the discontinuous peripheral boundaries 30 have a plurality of spaced notches 42 with tabs 40 therebetween. In other specific embodiments, each of the notches 42 are equally spaced and of equal size. In another specific embodiment, each of the tabs 40 are equally spaced and of equal size. In still other specific embodiments, on a peripheral boundary 38, there are always greater than two tabs 40 and notches 42. In still other specific embodiments, the tabs 40 and notches 42 each measure in a direction of the boundary of more than the thickness of the material and are each less than one-half of the total length of the peripheral boundary 38. In each of the embodiments illustrated in FIGS. 5 and 7, the discontinuous peripheral boundary 38 is generally of a sinusoidal curve. In FIGS. 9–15, blanks of various rectilinear and curvalinear patterns having the discontinuous peripheral boundary generally of rectangular tabs and notches, showing still other tab and notch shapes.

In performing the method of the invention, a coiled ribbon 32 of rolled sheet material is provided. The width of the ribbon 32 is limited to size only to the width that can be produced by a rolling mill and to the cubic size of the ingot being rolled. Blanks 20 are produced from the ribbon 32 by severing the ribbon 32 between the blanks 20 with a discontinuous cut in accordance with the invention producing a plurality of blanks 20, each of the blanks 20 having a part portion 26 surrounded by a peripheral portion 28. The peripheral portion 28 has, in all cases, a predominant peripheral portion 30 which is discontinuous.

In a specific embodiment, the peripheral portion 28 has a shared discontinuous portion 44 and an unshared continuous portion 46.

In a specific embodiment, this peripheral portion 28 may include a bead 24. In some embodiments, the bead 24 is in the discontinuous peripheral portion 30. In other embodiments, the Dead 24 is in the unshared continuous portion 46.

In all embodiments, the scrap portion 28 is adapted to be positioned between the upper 16 and lower 18 binder of the sheet material forming tooling to be used in the sheet material forming process. In the embodiment shown in FIG. 5, the blanks 20 are circular in shape and the scrap portion 28 includes a predominant peripheral portion 30 which is discontinuous around the entire blank 20 thereby forming a discontinuous blank periphery of boundary 38. In the embodiment shown in FIG. 6, a rectangular/square blank 20 is shown having a scrap portion 28 which includes a pair 54 of unshared portions 46 and a pair 54 or shared discontinuous portions 44. The unshared portions 46 define the longitudinal boundaries 38 of ribbon 32. The blank shown in FIG. 7 also includes a pair of opposite peripheral portions 44 which are shared and an unshared scrap portion 46 which defines the longitudinal boundaries 38 of the ribbon 32 of sheet metal from which the blanks are formed.

Thus, as illustrated in FIG. 6, there are a multiple of blank severing steps performed, each with a discontinuous cut transversely of the coiled ribbon 32 of sheet material from the which the blanks are formed.

Referring to FIG. 7, the multiple severance of blanks 20 by a discontinuous cut is performed both longitudinally and transversely of the ribbon 32 of sheet metal from which the blanks are made. In addition, there are three columns 36 and multiple rows 34 of blanks 20. In the specific embodiment illustrated, the blanks 20 are rectangular/square in shape and have a peripheral shared discontinuous portion 44 only the exterior blanks 20 have an unshared portion 46 which extends between two shared portion 44.

The blanks 20 illustrated in FIG. 7 include outer blanks in which there are opposite discontinuous peripheral portions 28 and a third discontinuous portion 28 interconnecting the two opposite discontinuous portions 28 plus the remaining portion 28 which is continuous and defines the longitudinal edge 48 of the ribbon 32 of sheet metal. The interior column(s) (there being only one column shown) include blanks which have two pairs of peripheral portions which are each shared with adjacent blanks and are each discontinuous.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A die forming process blank of sheet material comprising a part portion and a peripheral portion, said peripheral portion being provided for both holding said blank in a die and furnishing material to said part portion during the die forming process as required, said peripheral portion having an undulating real boundary and a discontinuous effective boundary, said peripheral portions of adjacent part portions prior to being cut from said sheet material consisting of all of the material between said adjacent part portions, whereby scrap is shared by said adjacent part portions.

2. The blank of claim 1 wherein said part portion has a flow restriction therein.

3. The blank of claim 1 wherein a flow restriction is in said peripheral portion.

4. The blank of claim 1 wherein a bead is in a scrap portion between said part portion and said peripheral portion.

5. The blank of claim 1 wherein said blank is rectangular and has at least one boundary of said peripheral portion which is discontinuous.

6. The blank of claim 1 wherein said blank is rectangular and has at least two boundaries of said peripheral portion which are discontinuous.

7. The blank of claim 1 wherein said blank is rectangular and has at least three adjacent boundaries of said peripheral portion which are discontinuous.

8. The blank of claim 1 wherein said blank is rectangular and has four boundaries of said peripheral portion which are discontinuous.

9. The blank of claim 1 wherein said blank is circular and the entire boundary of said peripheral portion is discontinuous.

10. The blank of claim 1 wherein said peripheral portion has a plurality of tabs and notches.

11. The blank of claim 10 wherein said tabs and notches are each radiused.

12. The blank of claim 10 wherein said tabs and notches have a neck and a head, said head being spaced from the remainder of said blank by said neck.

13. The blank of claim 10 wherein said tabs and notches are rectangular in shape with radiused corners.

14. The blank of claim 11 wherein said discontinuous peripheral portion includes a plurality of spaced notches with tabs therebetween.

15. The blank of claim 14 wherein said tabs and notches are equally spaced.

16. The blank of claim 14 wherein said tabs and notches are of equal size.

17. The blank of claim 14 wherein said tabs and notches includes more than 2 tabs.

18. The blank of claim 14 wherein said tabs and notches have a dimension in the direction of the boundary greater than the material thickness and less than one-half of said boundary.

19. The blank of claim 14 wherein said tabs and notches form a generally sinusoidal, scalloped boundary.

20. The blank of claim 10 wherein said tabs and notches are triangular in shape with radiused corners.

21. The blank of claim 10 wherein said tabs and notches are square in shape with radiused corners.

22. Die forming process blanks of sheet material comprising a plurality of blanks, each of said blanks having a part portion surrounded by a peripheral portion, said peripheral portion being provided for both holding said blank in a die and furnishing material to said part portion during the die forming process as required, said peripheral portions including both an undulating real boundary and a discontinuous effective boundary, said sheet portion between said part portions of said blanks consisting of the peripheral portions of adjacent part portions whereby said sheet material between adjacent part portions is shared and said sheet material is efficiently utilized.

23. The plurality of blanks of claim 22 wherein said shared port ion has a discontinuous boundary less than said peripheral portion.

24. The plurality of blanks of claim 22 wherein said shared peripheral portion has both a shared portion and an unshared portion, said shared portion including the blank periphery or edge, said unshared portion being between said shared portion and said part portion.

25. The plurality of blanks of claim 24 wherein said peripheral portion has a discontinuous boundary and a bead, said bead being within said unshared portion.

26. The plurality of blanks of claim 22 wherein said peripheral portion bas a discontinuous boundary and a bead, said bead being within said shared portion.

27. The plurality of blanks of claim 22 wherein each of said blanks have two pair of opposite peripheral portions, one pair of said opposite portions including a shared portion, said other pair of said opposite portions being unshared portions, said shared portion having a discontinuous boundary.

28. The plurality of blanks of claim 22 wherein each of said blanks have a pair of opposite peripheral portions including a shared portion, said shared portion having a discontinuous boundary.

29. The plurality of blanks of claim 22 wherein each of said blanks have two pair of opposite peripheral portions, one pair of said opposite portions including a shared portion, one of said portions of said other opposite pair of portions being a shared portion, the other of said portions of said other pair of portions being an unshared portion, said shared portions having a discontinuous boundary.

30. The plurality of blanks of claim 22 wherein said blanks are arranged on said sheet material in two columns extending longitudinally of said sheet material with a shared boundary between said columns, each of said columns defining an exterior longitudinal boundary of said sheet.

31. The plurality of blanks of claim 30 wherein said each of said blanks have two pair of opposite peripheral portions, one of said pair of said opposite portions having a shared portion, said shared portion having a discontinuous boundary.

32. The plurality of blanks of claim 31 wherein said blanks are arranged in at least three columns of blanks on said material, each of said columns having an axis extending longitudinally of said material, said plurality of blanks each being in a row bounded by two adjacent rows of blanks on said material, said rows including a pair of exterior blanks having one of said pairs of opposite portions defining the exterior peripheral boundaries of said material.

33. The plurality of blanks of claim 31 wherein there are a plurality of columns of blanks bounded by adjacent columns of blanks in said material.

34. The plurality of blanks of claim 22 wherein said blank is rectangular and has at least one opposite boundary of said peripheral portion which is discontinuous.

35. The plurality of blanks of claim 22 wherein said blank is rectangular and has at least two opposite boundaries of said peripheral portion which is discontinuous.

36. The plurality of blanks of claim 22 wherein said blank is rectangular and has at least three adjacent boundaries of said peripheral portion which are discontinuous.

37. The plurality of blanks of claim 22 wherein said blank is rectangular and has four boundaries of said peripheral portion which are discontinuous.

38. The plurality of blanks of claim 22 wherein said blank is circular and the entire boundary of said peripheral portion is discontinuous.

39. The plurality of blanks of claim 22 wherein said discontinuous peripheral portion has a plurality of tabs and notches.

40. The plurality of blanks of claim 39 wherein said tabs and notches are each radiused.

41. The plurality of blanks of claim 39 wherein said tabs and notches have a neck and a head, said head being spaced from the remainder of said blank by said neck.

42. The plurality of blanks of claim 39 wherein said tabs and notches are rectangular in shape with radiused corners.

43. The plurality of blanks of claim 22 wherein said discontinuous peripheral portion includes a plurality of spaced notches with tabs therebetween.

44. The plurality of blanks of claim 43 wherein said tabs and notches are equally spaced.

45. The plurality of blanks of claim 43 wherein said tabs and notches are of equal size.

46. The plurality of blanks of claim 43 wherein said tabs and notches are greater than two.

47. The plurality of blanks of claim 43 wherein said tabs and notches have a dimension in the direction of the boundary greater than material thickness and less than one-half of said boundary.

48. The plurality of blanks of claim 39 wherein said tabs and notches are triangular in shape with radiused corners.

49. The plurality of blanks of claim 39 wherein said tabs and notches are square in shape with radiused corners.

50. A die forming process blank of sheet material comprising a part portion surrounded by a scrap portion, said scrap portion having a peripheral portion, said peripheral portion being provided for both holding said blank in a die and furnishing material to said part and scrap portions during the die forming process as required, said peripheral portion having an undulating real boundary and a discontinuous effective boundary, said peripheral and scrap portions of adjacent part portions prior to being cut from said sheet material consisting of all of the material between said adjacent part portions, whereby scrap is shared by said adjacent part portions.

51. Die forming process blanks of sheet material comprising a plurality of blanks, each of said blanks having a part portion surrounded by a scrap portion, said scrap portion having a peripheral portion, said peripheral portion being provided for both holding said blank in a die and furnishing material to said part and scrap portions during the die forming process as required, adjacent blanks sharing said scrap portion, said scrap portions having both an undulating real boundary and a discontinuous effective boundary, said sheet portion between said part portions of said blanks consisting of said scrap portions of adjacent part portions whereby said sheet material between adjacent part portions is shared and said scrap portion is minimized.

* * * * *